US005496039A

United States Patent [19]

Zammuto

[11] Patent Number: 5,496,039

[45] Date of Patent: Mar. 5, 1996

[54] DART GAME APPARATUS

[75] Inventor: Samuel N. Zammuto, Rockford, Ill.

[73] Assignee: Arachnid, Inc., Rockford, Ill.

[21] Appl. No.: 249,842

[22] Filed: May 26, 1994

[51] Int. Cl.[6] ..... F41J 3/00

[52] U.S. Cl. ..... 273/368; 273/404; 273/408

[58] Field of Search ..... 273/403, 408, 273/368, 404, 348, 407, 366, 367, 377

[56] References Cited

U.S. PATENT DOCUMENTS

| | | | |
|---|---|---|---|
| 626,500 | 6/1899 | McCullough | 273/368 |
| 1,488,647 | 4/1924 | Quinn | 273/368 |
| 2,077,001 | 4/1937 | Moss et al. | 273/102 |
| 2,165,147 | 7/1939 | Moss | 273/102.2 |
| 2,179,471 | 11/1939 | Lee | 273/105.2 |
| 2,231,049 | 2/1941 | Berman | 273/105.2 |
| 2,905,469 | 9/1959 | Taylor | 273/408 |
| 3,413,003 | 11/1968 | Bell | 273/408 |
| 3,552,749 | 1/1971 | Piggotte | 273/1.5 |
| 3,850,432 | 11/1974 | Crocker | 273/368 |
| 4,042,242 | 8/1977 | Nicholls et al. | 273/105.2 |
| 4,333,657 | 6/1982 | Jaworski et al. | 273/376 |
| 4,384,723 | 5/1983 | Anderson | 273/408 |
| 4,548,414 | 10/1985 | Denis | 273/368 |
| 5,020,806 | 6/1991 | Martin | 273/371 |

FOREIGN PATENT DOCUMENTS

| | | | |
|---|---|---|---|
| 2465503 | 4/1981 | France | 273/408 |
| 408711 | 9/1966 | Switzerland . | |
| 1527631 | 10/1978 | United Kingdom | 273/408 |
| 1015729 | 10/1991 | WIPO | 273/408 |

*Primary Examiner*—Mark S. Graham
*Attorney, Agent, or Firm*—Leydig, Voit & Mayer, Ltd.

[57] ABSTRACT

A dart game apparatus adapted for play in combination with darts is provided for. The dart game apparatus comprises a backstop. The backstop includes a vertical surface adapted to intercept errant darts. The dart game also includes a rotatable target assembly. The target assembly has a hub rotatably mounted to the backstop forward of the vertical surface, one or more arms radiating outward from the hub, and a dart board mounted on each of the arms. The dart boards include a plurality of target segments adapted to capture darts striking the target segments.

20 Claims, 4 Drawing Sheets

DART GAME APPARATUS

FIELD OF THE INVENTION

This invention relates to dart game apparatus and, more particularly, to dart game apparatus having rotating dart targets.

BACKGROUND OF THE INVENTION

Dart playing has reached record popularity levels thanks in large part to the introduction of soft-tipped darts and electronic dart targets such as those disclosed in U.S. Pat. No. 4,057,251 to R. Jones et al., U.S. Pat. No. 4,793,618 to M. Tillery et al., and U.S. Pat. No. 5,114,155 to M. Tillery et al. Dart players are becoming increasingly more skilled, and many leagues and tournaments are conducted throughout the world.

Nevertheless, there is a continuing desire on the part of dart players for new, more challenging, and more interesting dart games. Manufacturers also continue to seek dart games which are susceptible to commercial use in arcades, carnivals, and the like, and they have a continuing need to generate player excitement and interest at dart tournaments, trade shows, and other events at which they promote their dart related products. The subject invention satisfies those seemingly unrelated needs by providing a novel rotating dart game apparatus as described further below.

Various dart game machines have been proposed in which a rotating dart board is used, such as those disclosed in U.S. Pat. No. 2,179,471 to M. Lee, U.S. Pat. No. 2,165,147 to L. Moss, and U.S. Pat. No. 2,077,001 to L. Moss et al. Those games, however, all utilize a single dart board which rotates about the central axis of the dart board. The dart board has no translational movement, and thus, the challenge of hitting the board is limited. Moreover, those dart game machines are poorly suited for commercial or promotional use. They are relatively small and inconspicuous and, therefore, do not generate the visual excitement necessary to call attention to themselves or to a particular location.

Those prior art games also utilize steel-tipped darts, and thus, present the hazards associated with steel-tipped darts. They also generally have no means for collecting errant darts. Some have a dart board which is mounted in a panel made of wood or similar penetrable material into which errant darts will embed, but errant darts then must be physically removed one by one from the panel, and the panel itself must be replaced periodically.

It is an object of the subject invention, therefore, to provide dart games which present a new, interesting, and challenging experience for dart players of all levels.

It also is an object of the subject invention to provide dart games which are capable of generating more visual excitement and are more suited to promotional and commercial use.

Another object is to provide such dart games which utilize soft-tipped darts.

Yet another object of the subject invention is to provide dart games which have means for collecting errant darts.

A further object is to provide dart games wherein all of the above advantages are realized.

Those and other objects and advantages of the invention will be apparent to those skilled in the art upon reading the following description and upon reference to the drawings.

SUMMARY OF THE INVENTION

The subject invention provides for a dart game apparatus adapted for play in combination with soft-tipped darts. The dart game apparatus comprises a backstop. The backstop includes a vertical surface adapted to intercept errant darts.

The dart game also includes a rotatable target assembly. The target assembly has a hub rotatably mounted to the backstop forward of the vertical surface, one or more arms radiating outward from the hub, and a dart board mounted on each of the arms. The dart boards include a plurality of target segments adapted to capture darts striking the target segments.

DETAILED DESCRIPTION OF THE INVENTION

The dart games of the subject invention comprise a rotatable target assembly which includes one or more dart boards. The target assembly is mounted forward of a backstop, the backstop being adapted to support the target assembly and to intercept darts which miss the dart boards.

FIGS. 1–6 show a preferred embodiment 10 of the dart games of the subject invention which is adapted for use with soft-tipped darts. As may be seen in FIG. 1, the dart game 10 generally comprises a backstop 20 and a rotatable target assembly 30.

Figure 1:
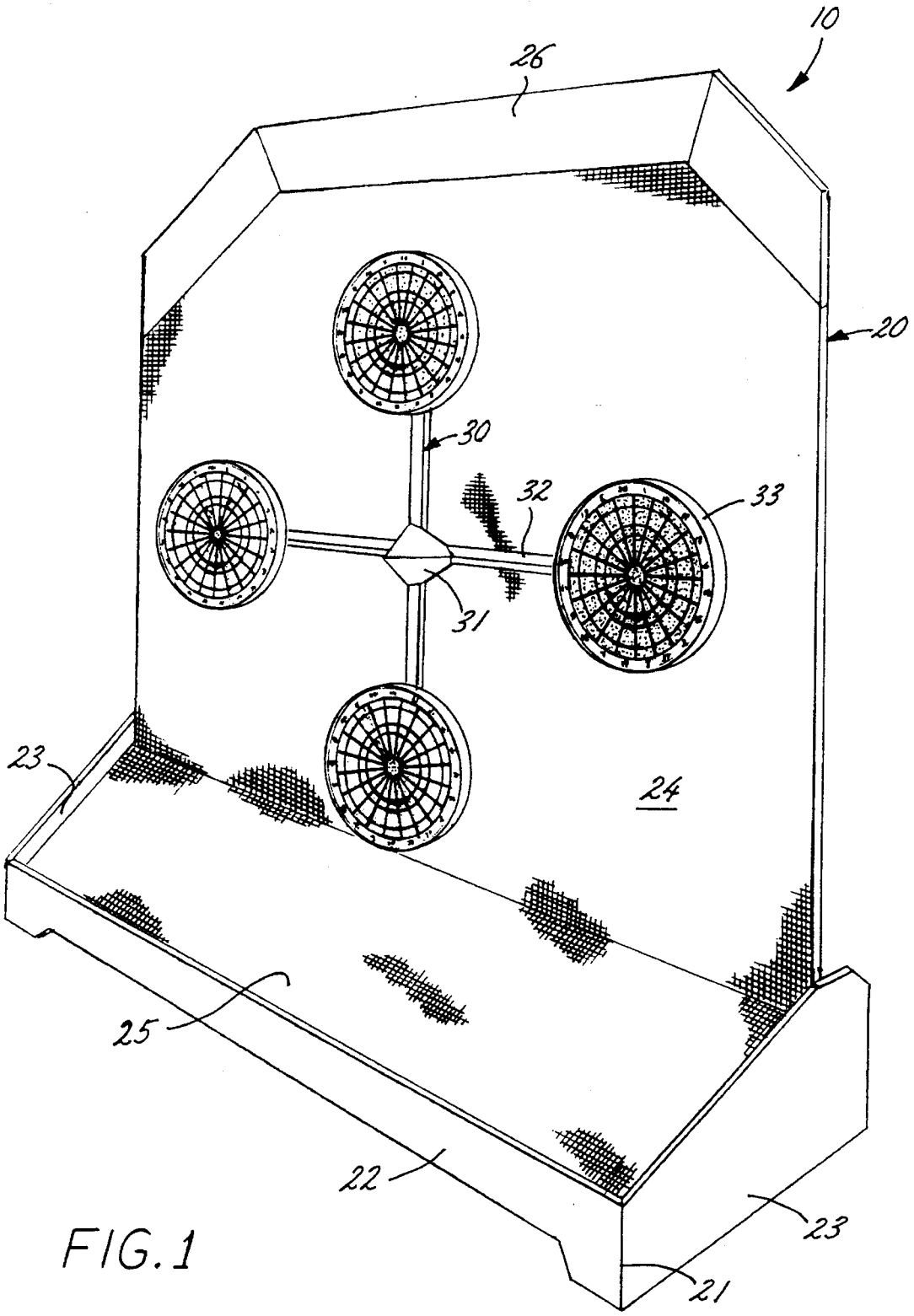
FIG. 1 is a front and right side perspective view of a preferred embodiment 10 of the dart games of the subject invention.
Figure 2:
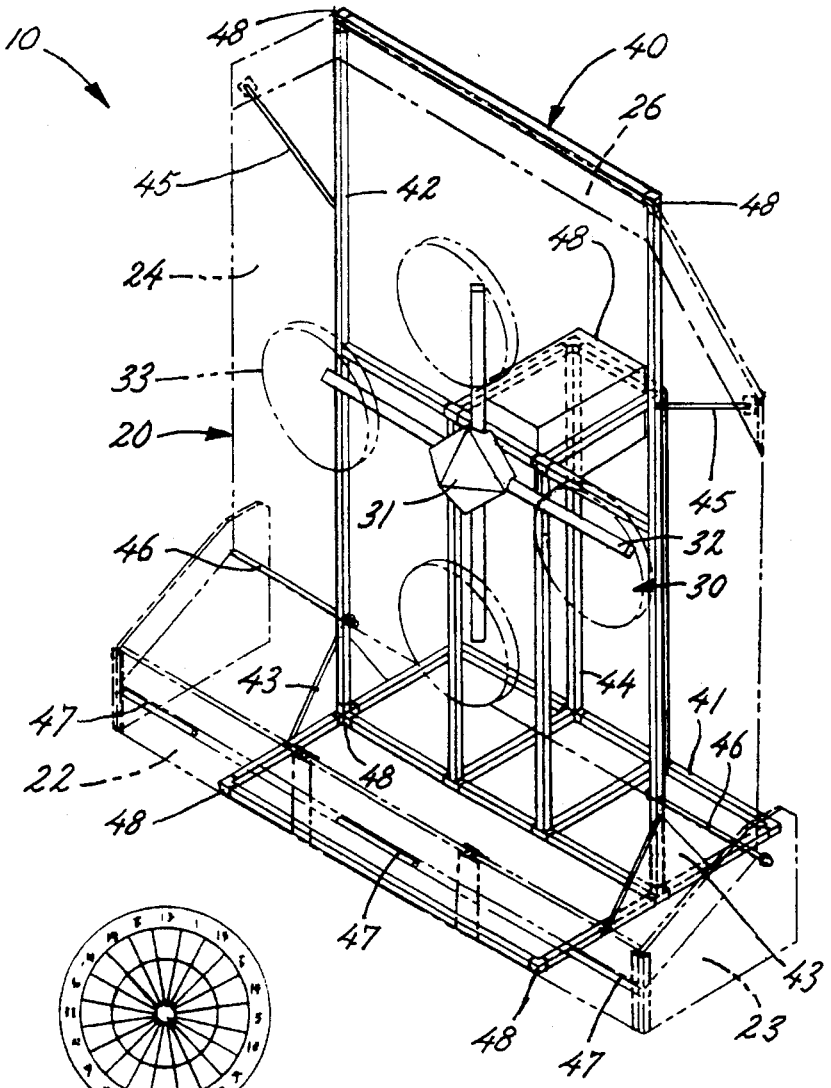
FIG. 2 is a front and right side perspective of the dart game 10 shown in FIG. 1, certain features thereof being shown in phantom to further illustrate the construction of the dart game 10.
Figure 3:
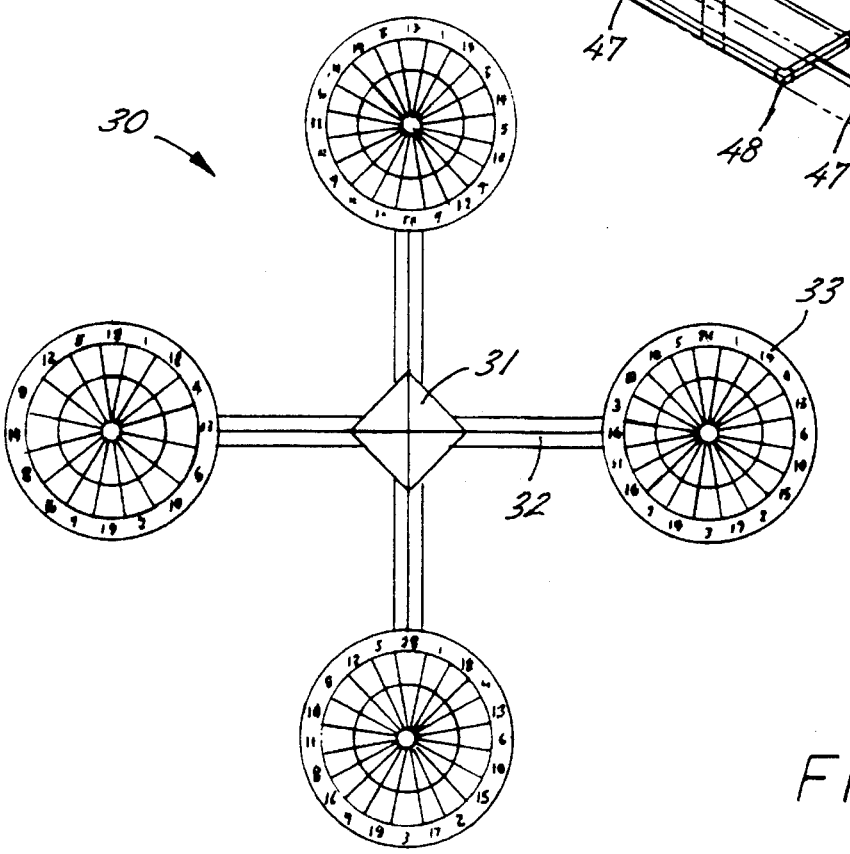
FIG. 3 is a front elevational view of the target assembly 30 of the dart game 10 shown in FIG. 1.

The target assembly 30, as seen best in FIGS. 1–2, has a hub 31 from which radiate four arms 32. A dart board 33 is mounted at the end of each arm 32. The dart boards 33 may be mounted to the arms 32 by any suitable means, e.g., by clamps 34 shown in FIG. 5. The dart boards also may be mounted for rotation on the arms, if desired, by any suitable means. Likewise, the target assembly may include greater or lesser numbers of dart boards.

The illustrative dart game 10, as previously noted, is adapted for play with soft-tipped darts. Accordingly, the dart boards 32, as seen best in FIG. 6, each include a plurality of radially extending ribs 35 and concentric circular ribs 36 which divide the dart board into a plurality of target segments 37. Each target segment 37 contains a large number of closely spaced holes which correspond substantially to the cross-sectional dimension of the tips of the dart, the holes thereby providing means for capturing darts which strike the target segments 37. Preferably, the dart boards 32 include a peripheral border 38 which also has a large number of such closely spaced holes adapted to captivate darts hitting the border 38. Dart boards of this type typically are fabricated from injection molded plastics and are well known, for example, as disclosed in U.S. Pat. No. 4,706,962 to D. Michalski.

It will be appreciated, however, that the target assembly may be provided with electronic dart boards, for example, as described in the aforementioned Jones '251 patent. Suitable displays may be mounted on the backstop, and the electronic dart board and display controlled by microprocessors, as will be readily appreciated by workers of ordinary skill in the art.

The dart games of the subject invention preferably are adapted for use with soft-tipped darts because such darts are considerably less hazardous than steel-tipped darts. The novel dart games, however, can be adapted for use with steel-tipped darts. In that event, the dart board is composed of cork, bristle board, or another penetrable material in which darts striking the board may embed. Electronically scored dart boards for steel-tipped darts are known and may be used if desired.

The target assembly of the novel dart games is rotatably mounted on and supported by the backstop. The backstop 20 is adapted to support the target assembly 30 and to deflect darts which miss the dart boards 32, allowing errant darts to fall into a dart well.

In accordance therewith, the backstop 20 includes a base 21 which has an upstanding front wall 22 and two upstanding side walls 23 which extend back from each end of the front wall 22. The base preferably is made of structural material such as plywood or plexiglass.

Figure 4:
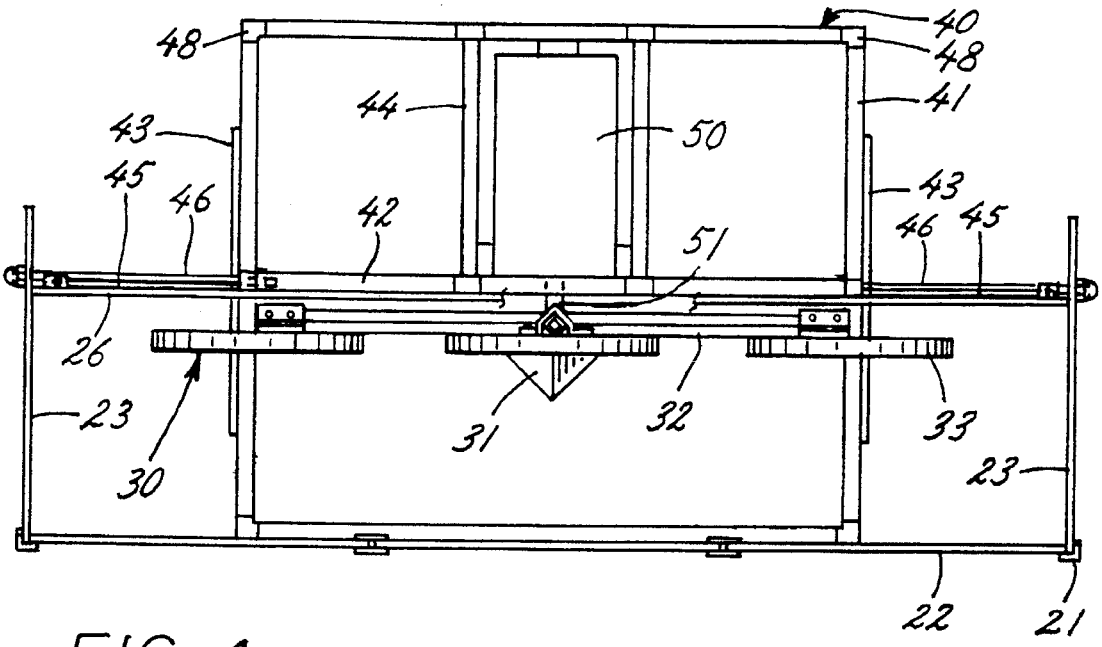
FIG. 4 is a top plan view of the dart game 10 shown in FIG. 1, certain features being omitted for clarity.
Figure 5:
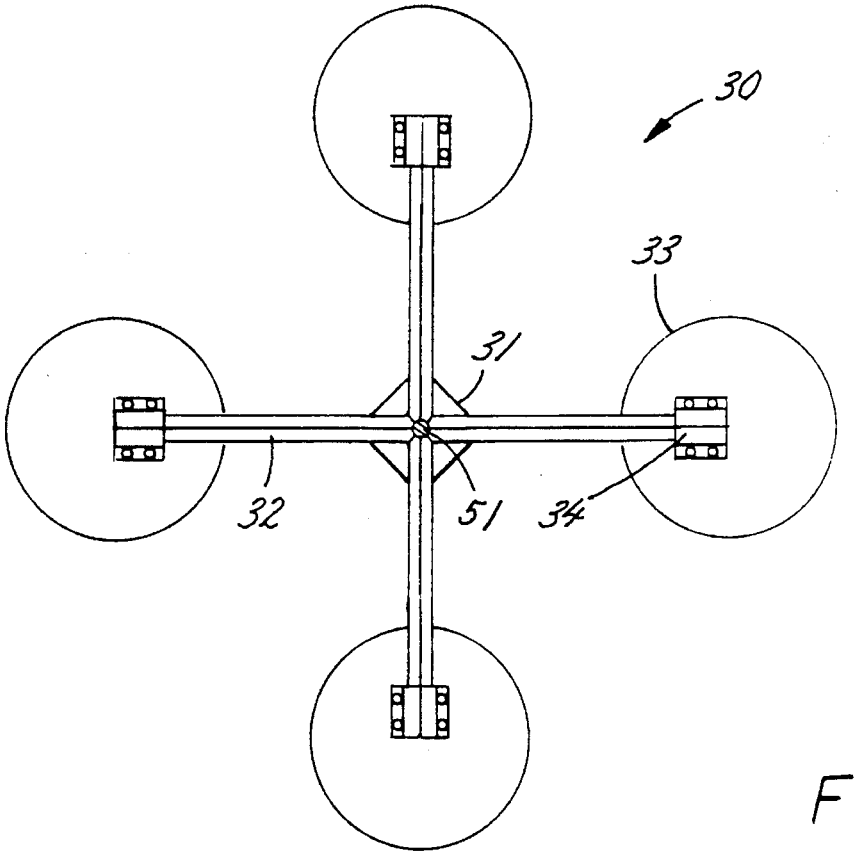
FIG. 5 is a back elevational view of the target assembly 30 shown in FIG. 3.
Figure 6:
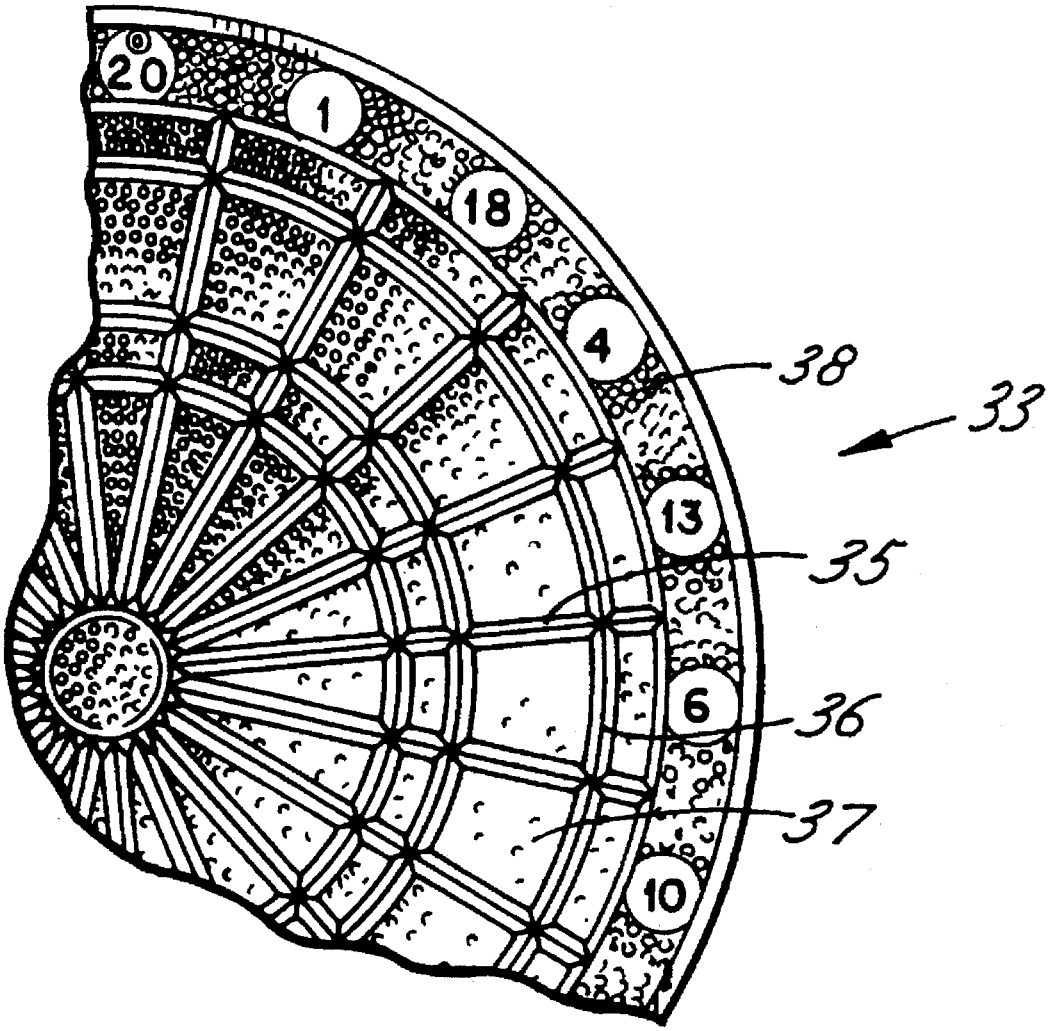
FIG. 6 is an enlarged view of a representative portion of a dart target 33 of the target assembly 30 shown in FIG. 3.

The backstop 20 also includes a frame 40 as seen best in FIGS. 2 and 4. The frame 40 has a rectangular foot 41 which rests on the ground surface and a vertical portion 42 which extends upwards from the foot 41. The foot 41 has a sufficiently large length and width to provide stability for the frame 40, and gusset plates 43 or other reinforcing members may be provided to enhance the rigidity of the frame 40. The frame 40 also includes a support cage 44 which is integral with and rearward of the vertical portion 42 of the frame 40. The support cage 44 is adapted to mount a drive assembly 50 described in detail below.

The frame may be made of any suitable structural material, but preferably is constructed from lightweight, rigid materials such as polyvinyl chloride, steel, or aluminum tubing. Preferably, as shown in the illustrative embodiment, the frame 40 is assembled from sections of tubular material which are joined by appropriate connectors so that the frame may be assembled and disassembled for transportation from location to location. Such connections may be made with nuts and bolts, or, as shown, connectors 48 in which the ends of the tube sections are frictionally engaged.

The drive assembly 50 includes a drive shaft 51 which is coupled to the hub 31 of target assembly 30. The precise configuration of the drive assembly is a matter of choice, and it can include, for example, an AC drive motor having a gear reduction unit connected to a frictional drive or tortional type clutch. The clutch may be connected to the drift shaft via a chain or belt drive. A rheostat, potentiometer, or the like may be used to control the speed of the motor, and thus, of the rotation of the target assembly. Suitable switches and the like preferably are provided to facilitate operator control over the game. Such controls may be mounted on the game itself, or the game may utilize wired or wireless remote controls. Suitable drive mechanisms and their associated controls are well known in the art. The drive assembly, however, may be omitted entirely, and the target assembly mounted for free rotation and rotated by hand if desired.

The novel dart games preferably include panels which may be decorated to enhance the appearance of the game or imprinted with appropriate signage or instructions. The base 21 may be used for such purposes. Preferably, however, the dart game also includes panels such as panels 26 which are mounted on the upper end of the frame vertical portion 42.

As noted previously, the backstop 20 is adapted to deflect errant darts into a dart well. In accordance therewith, the base 21 and frame 40 are adapted to support a web 24, as shown in FIG. 1 (the web 24 is omitted from FIG. 4 so that details of the frame 40 may be shown). The web 24 provides a surface upon which errant soft-tipped darts first may be deflected and then collected. That is, the web 24 has a upper portion generally adjacent to and forward of the frame vertical portion 42. The upper portion of the web 24 extends in a substantially vertical plane at least coextensively with, and preferably somewhat beyond the area circumscribed by the rotating target assembly 30, i.e., the area directly behind the rotating target assembly 30. The material for the web 24 preferably is selected such that it does not allow soft-tipped darts to stick therein. Thus, the upper portion of the web 24 provides a vertical surface upon which darts missing the target assembly 30 may be deflected, allowing such errant darts to fall onto a lower portion of the web 24. The lower portion of the web 24 extends generally between the front wall 22 and side walls 23 of the base 21. It is inclined slightly downward toward the front wall 22 of the base 21, and being recessed somewhat from the upper edges of the front wall 22 and side walls 23 of the base 21, serves along with the base 21 to define a dart well 25. That is, errant darts deflected off the vertical upper portion of the web 24 will tend to collect on the lower portion of the web 24 in the dart well 25.

In accordance therewith, the web 24 preferably is made from a woven fabric or a plastic sheet. Such materials will deflect errant soft-tipped darts and also are durable, lightweight, and inexpensive. Rigid materials are less preferred because they can damage the tips of soft-tipped darts, but can be used to provide a deflection surface on the backboard if desired.

The web 24 may be attached or suspended from the frame 40 in any suitable manner. For example, as shown in the illustrative dart game 10, the web 24 is a woven fabric, the upper edge of which is attached to the upper horizontal member of the frame vertical portion 42 by Velcro strips. Rods 45 and 46 are provided to assist in hanging the cloth web 24. Rods 45 pass through suitable loops, channels or the like sewn into the fabric web 24 and extend from the frame vertical portion 42 to the ends of panels 26. Rods 46 also may be passed through sewn-in loops and the like. Rods 46 extend between the base sidewalls 23 and the frame vertical portion 42. Rods 45 and 46 may be provided with threaded ends, passed through suitable openings in the frame and base, and secured with nuts, or otherwise secured as desired. The lower edge of the fabric web 24 has sewn-in dowels 47 which may be snapped into a channel in the back of the base front wall 22 provided for that purpose. A variety of means, such as snaps, loops, clips, hooks, pockets, screws and the like, are familiar to those skilled in the art and may be used, however, to suspend the web.

The dart games of the subject invention preferably utilize a backstop as describe above or its equivalent. The illustrative backstop is easily and economically constructed. Moreover, the backstop may be easily assembled and disassembled so that the dart game may be transported and used at various locations. It will be appreciated, however, that the backstop is susceptible of considerable variation consistent with its function of intercepting errant darts and supporting the target assembly. The frame may be constructed in a variety of different ways and many different materials may be used for the web. When rigid structural materials are used for the web, the frame may be unnecessary. Many modifications and variations will be apparent to workers in the art.

For example, in general it is preferred that errant darts be deflected off the backstop vertical surface because, especially when combined with a dart well, errant darts may be more easily collected and returned to play. If desired, however, the web can be fabricated from plastic materials having closely spaced holes which captivate errant soft-tipped darts, analogous to the dart boards themselves. Also, if the game is to be played with steel-tipped darts, it generally is desirable to fabricate the web from penetrable material in which errant darts can embed, as otherwise the tips will become blunted and dull. If the backstop is designed so that darts will be captured in the vertical surface, instead of deflected therefrom, the target assembly should be mounted forward of the backstop vertical surface a distance at least equal to the length of the darts with which the game will be played. Errant darts, therefore, can embed in the backstop vertical surface, yet they will not interfere with rotation of the target assembly.

It will be appreciated from the foregoing description, therefore, that even as compared to prior art dart games which utilize a rotating dart board, the dart games of the subject invention present a challenging game for dart players of all levels. That is, the dart boards themselves are moving, not simply rotating, and the difficulty of hitting the dart board in increased commensurately.

Equally important, however, the novel dart games create considerably more visual excitement. The rotating arms are quite conspicuous. The large surface area provided by the backstop also provides a medium for printed indicia. The backstop can carry additional signage panels which further increase the visual excitement of the dart game. Thus, the novel dart games can be used to attract attention and draw a crowd to a manufacturers' booth in a trade show or any other location where product information is provided. This high visibility of the novel dart games also increases the amount of play when the games are used in commercial settings such as arcades and carnivals.

It also will be appreciated that the novel dart games, when adapted for use with soft-tipped darts, offer further advantages. The backstop can be adapted easily to deflect errant darts without damage to the darts or backstop. Errant darts can be deflected into a dart well, where they can be easily collected and put back into play. This will help to increase the pace of play, which is especially desirable in commercial settings. Further, when the novel dart games are adapted for use with soft-tipped darts, they may be used in situations where the risks associated with steel-tipped darts are unacceptable.

This invention has been disclosed and discussed primarily in terms of specific embodiments thereof, but it is not intended to be limited thereto. Other modifications and embodiments will be apparent to the worker in the art.

We claim as our invention:

1. A dart game apparatus adapted for play in combination with darts, the dart game apparatus comprising:

a backstop, the backstop including a frame having a foot and a vertical portion upstanding from the foot; and a web mounted on the frame vertical portion, the web providing a backstop vertical surface adapted to intercept errant darts; and a target assembly, the target assembly including a hub rotatably mounted to the backstop forward of the vertical surface;

one or more arms radiating outward from the hub; and a dart board mounted on each of the arms;

the dart board or dart boards including a plurality of target segments, the target segments being adapted to capture darts striking the target segments.

2. The dart game apparatus of claim 1, wherein the backstop includes a dart well adapted to receive darts deflected by the backstop vertical surface.

3. The dart game apparatus of claim 1, wherein the backstop includes a drive assembly having a drive shaft coupled to the hub of the target assembly.

4. The dart game apparatus of claim 1, wherein the dart board or dart boards are fixedly mounted on the arms of the target assembly.

5. The dart game apparatus of claim 1, wherein the target assembly includes four arms and four dart targets.

6. The dart game apparatus of claim 1, wherein the dart board or dart boards includes a border adapted to capture darts striking the border.

7. The dart game apparatus of claim 1, wherein the backstop vertical surface extends at least coextensively with the area circumscribed by the rotating target assembly.

8. A dart game apparatus adapted for play in combination with darts, the dart game apparatus comprising:

a backstop, the backstop including a frame having a foot and a vertical portion upstanding from the foot; and a web mounted on the frame vertical portion, the web providing a backstop vertical surface adapted to intercept errant darts; and a target assembly, the target assembly including a hub rotatably mounted to the backstop forward of the vertical surface;

one or more arms radiating outward from the hub;

and a dart board mounted on each of the arms;

the dart board or dart boards including a plurality of radially extending ribs and concentric circular ribs dividing the dart board or dart boards into a plurality of target segments, each target segment containing a large number of closely spaced holes corresponding substantially to the cross-sectional dimension of the tip of a dart.

9. The dart game apparatus of claim 8, wherein the backstop includes a dart well adapted to receive darts deflected by the backstop vertical surface.

10. The dart game apparatus of claim 8, wherein the backstop includes a drive assembly having a drive shaft coupled to the hub of the target assembly.

11. The dart game apparatus of claim 8, wherein the backstop includes a drive assembly mounted on the frame, the drive assembly having a drive shaft coupled to the hub of the target assembly.

12. The dart game apparatus of claim 8, wherein the dart board or dart boards are fixedly mounted on the arms of the target assembly.

13. The dart game apparatus of claim 8, wherein the dart board or dart boards includes a border having a large number of closely spaced holes corresponding substantially to the cross-sectional dimension of the tip of a dart.

14. The dart game apparatus of claim 8, wherein the target assembly includes four arms and four dart targets.

15. The dart game apparatus of claim 8, wherein the web is composed of a woven fabric or plastic sheet.

16. The dart game apparatus of claim 8, wherein the backstop vertical surface extends at least coextensively with the area circumscribed by the rotating target assembly.

17. A dart game apparatus adapted for play in combination with soft-tipped darts, the dart game apparatus comprising:

a backstop, the backstop including a frame having a foot and a vertical portion upstanding from the foot;

a base having upstanding side walls and an upstanding front wall extending between the side walls forward of the frame vertical portion; and a web having an upper portion, the web upper portion being mounted on the frame vertical portion and providing a backstop vertical surface adapted to deflect errant darts, and a lower portion, the web lower portion extending between the front and sidewalls of the base and being recessed relative to the upper edges thereof, the web lower portion and base defining a dart well; and a target assembly including a hub rotatably mounted to the backstop forward of the vertical surface;

one or more arms radiating outward from the hub; and a dart board mounted on each of the arms;

the dart board or dart boards including a plurality of radially extending ribs and concentric circular ribs dividing a dart board or dart boards into a plurality of target segments, each target segment containing a large number of closely spaced holes corresponding substantially to the cross-sectional dimension of the tip of a dart.

18. The dart game apparatus of claim 17, wherein the web is composed of a woven fabric or plastic sheet.

19. The dart game apparatus of claim 17, wherein the backstop includes a drive assembly having a drive shaft coupled to the hub of the target assembly.

20. The dart game apparatus of claim 17, wherein the backstop vertical surface extends at least coextensively with the area circumscribed by the rotating target assembly.

* * * * *